US009818337B2

(12) United States Patent
Li et al.

(10) Patent No.: US 9,818,337 B2
(45) Date of Patent: Nov. 14, 2017

(54) LED DISPLAY CONTROL CIRCUIT WITH PWM CIRCUIT FOR DRIVING A PLURALITY OF LED CHANNELS

(71) Applicant: SCT TECHNOLOGY, LTD., Grand Cayman (KY)

(72) Inventors: Eric Li, Milpitas, CA (US); Shang-Kuan Tang, Fremont, CA (US); Wenjie Yang, GuangDong (CN); Yutao Chen, GuangDong (CN); Tianqi Qiu, Milpitas, CA (US); Jun Tian, Milpitas, CA (US); Hui Li, Milpitas, CA (US)

(73) Assignee: SCT TECHNOLOGY, LTD., Grand Cayman (KY)

( * ) Notice: Subject to any disclaimer, the term of this patent is extended or adjusted under 35 U.S.C. 154(b) by 6 days.

(21) Appl. No.: 14/340,410

(22) Filed: Jul. 24, 2014

(65) Prior Publication Data

US 2016/0027385 A1 Jan. 28, 2016

(51) Int. Cl.

*G09G 3/04* (2006.01)
*G09G 3/32* (2016.01)
*G09G 3/20* (2006.01)

(52) U.S. Cl.

CPC ..... *G09G 3/32* (2013.01); *G09G 3/2014* (2013.01)

(58) Field of Classification Search

CPC ..... G09G 3/30; G09G 3/32; G09G 3/3208; G09G 3/3216; G09G 3/3225; G09G 3/3233; G09G 3/3241

USPC ..... 345/33–35, 39, 82–84

See application file for complete search history.

(56) References Cited

U.S. PATENT DOCUMENTS 4,654,850 A * 3/1987 Rodrigues ..... G01R 31/31703 714/22
5,467,036 A * 11/1995 Sawada ..... B41J 2/355 327/108
5,644,328 A * 7/1997 Rhyne ..... G09G 3/20 345/204
6,425,054 B1 * 7/2002 Nguyen ..... G06F 9/30036 711/117
7,843,422 B1 * 11/2010 Ludden ..... G09G 3/3406 345/102
9,485,827 B2 * 11/2016 Li ..... H05B 33/086
9,747,872 B2 * 8/2017 Li ..... G09G 5/395
2001/0012015 A1 * 8/2001 Kang ..... G09G 5/363 345/542
2008/0202312 A1 * 8/2008 Zane ..... G09G 3/342 84/297 R
2009/0167348 A1 * 7/2009 Dorairaj ..... H03K 19/20 326/40
2011/0032008 A1 * 2/2011 Zhao ..... H03K 7/08 327/114
2011/0074799 A1 * 3/2011 Wu ..... G09G 3/2018 345/532

(Continued)

*Primary Examiner* — Alexander Eisen
*Assistant Examiner* — Nelson Lam
(74) *Attorney, Agent, or Firm* — Novick, Kim & Lee, PLLC; Allen Xue

(57) ABSTRACT

The current disclosure provides an LED display control circuit. The control circuit has a device configured to separate a first PWM data into LSB data and MSB data. The control circuit also comprises a LSB circuit coupled to a plurality of LED channels. The LSB circuit is configured to supply LSB data to each of the plurality of LED channels.

3 Claims, 4 Drawing Sheets

(56) References Cited

U.S. PATENT DOCUMENTS

Figure 1:
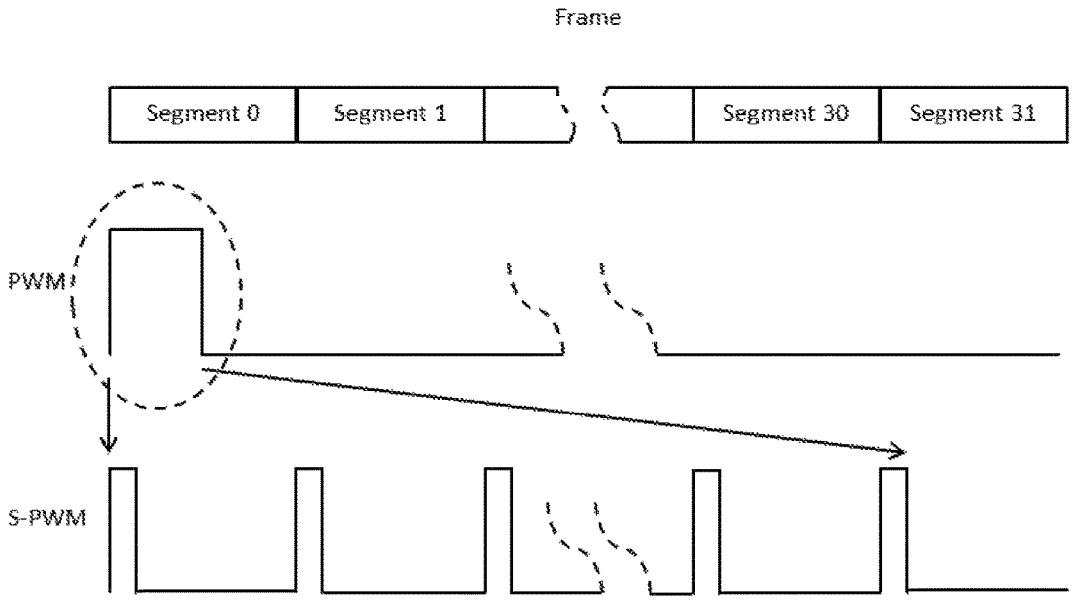
PRIOR ART FIG.1

| | | | | |
|---|---|---|---|---|
| 2011/0193648 | A1* | 8/2011 | Zhao | H03K 7/08 332/109 |
| 2013/0271019 | A1* | 10/2013 | Tsai | H05B 33/0827 315/192 |
| 2013/0278151 | A1* | 10/2013 | Lear | H05B 33/0839 315/164 |
| 2016/0019829 | A1* | 1/2016 | Li | G09G 3/32 345/690 |
| 2016/0027385 | A1* | 1/2016 | Li | G09G 3/32 345/82 |
| 2016/0379539 | A1* | 12/2016 | Hsieh | G09G 3/20 345/205 |

* cited by examiner

LED DISPLAY CONTROL CIRCUIT WITH PWM CIRCUIT FOR DRIVING A PLURALITY OF LED CHANNELS

TECHNICAL FIELD

The present disclosure relates generally to devices, circuits, and methods for controlling light emitting diode (LED) display panels. More particularly, the present disclosure relates to devices, circuits, and methods for controlling scan-type LED display panels.

BACKGROUND

Light emitting diodes (LEDs) have been widely used in electronic devices and applications, such as LED display panels. An LED display panel usually comprises an LED array and a LED control circuit that controls the LED array to display images. In a scan-type LED display, the LEDs in the LED array are arranged into rows and columns. In the LED array, a group of LEDs (e.g., arranged in a row or a column) can be coupled to a scan switch that turns the group of LEDs on and off. The group of LEDs is often referred to as a scan line. Another group LEDs can be coupled to a power source. The group of LEDs powered by the same power source is referred to as a channel. An LED simultaneously belongs to a scan line and a channel and emits light when the scan line it belongs to is on.

Furthermore, in an array of RGB LEDs (e.g. 16 columns×8 rows), each R, G, B LED may be powered by a different power source. Accordingly, there are a total of 48 channels to drive 16 columns of RGB LEDs. Each row of the LEDs is coupled to a switch, i.e., a scan line. The eight switches are turned on and off in a sequential manner, lighting up one row of LEDs at a time.

Used herein, the term "couple," "couples," "connect," or "connects" means either an indirect or direct electrical connection unless otherwise noted. Thus, if a first device couples or connects to a second device, that connection may be through a direct electrical connection, or through an indirect electrical connection via other devices or connections.

One parameter of an LED display is its gray scale value, which is the number of levels of brightness the display can show. The gray scale value equals $2^{number_of_control_bit}$. For example, a 16-bit resolution LED display has a gray scale value of $2^{16}=65536$, which means that the display can exhibit 65,536 level of brightness for each color. Accordingly, a RGB LED has $65536^3$ different color combinations. As such, a frame (i.e., an image) of a RGB LED display may display up to $65536^3$ colors.

Another parameter for an LED is the PWM value, which is the level of brightness of an LED is displaying. In a 16-bit resolution LED display, the PWM value ranges from 0 (complete darkness or black) to 65535 (maximum brightness or white). When the PWM value is low, it means that the brightness level of an LED is low. LED displays often experience performance issues at low PWM values.

Scrambled-PWM (S-PWM) is an enhanced version of PWM that enables a high visual refresh rate. S-PWM scrambles the "on" time in a PWM cycle into several shorter "on" periods and sequentially drives each scan line for a shorter "on" period. In other words, a total PWM value is scrambled into a number of PWM periods (i.e., segments) across a data frame. A data frame means data used to display a frame. In a conventional PWM scheme, there may be only one PWM pulse so that the LED emits light for a continuous time period, leaving the LED unlit for a long period of time. In contrast, S-PWM allows the LED to emit light in consecutive short pulses evenly across the data frame. By doing so, S-PWM increases the visual refresh rate. FIG. 1 illustrates an example of S-PWM, in which a data frame is divided into 32 segments and a PWM pulse is distributed among the 32 segments.

A further parameter for an LED display is its GCLK (i.e., Gray Scale Clock) frequency, which is related to the maximum number of GCLK cycles in a data frame and the refresh rate of the display. The frame rate is the number of times a video source can feed an entire frame of new data to a display in one second. The refresh rate of a LED display is the number of times per second the LED display draws the data. The refresh rate equals the frame rate multiplied by the number of segments.

The control-bit resolution for consumer electronics applications is usually 8 bits. For an 8-bit PWM resolution, there are 256 different gray scale levels. The corresponding PWM period has 256 clock cycles. For a typical 32 KHZ consumer-electronics clock frequency, a PWM period lasts 8 ms=256/32 KHZ. Accordingly, the PWM refresh rate is 125 HZ=⅛ ms. At 8-bit PWM resolution and 125 HZ refresh rate, the display provides sufficient gray scale adjustment and flicker elimination. However, in a 16-bit resolution display with a 2 KHz refresh rate, the GCLK frequency is 2000×65,536=131.072 MHz. Such high clock frequencies pose challenges to CMOS interface and LED driver's output ports.

As an alternative, the 16-bit control data can be divided among MSB (Most Significant Bit) and LSB (Least Significant Bit) for the emulation, whereby $$\text{Number_of_Segments}=2^{BIT_NUMBER_OF_LSB}$$

and $$\text{Width_of_One_Segments}=2^{BIT_NUMBER_OF_MSB}$$

Accordingly, the total width of one data frame is $$2^{(BIT_NUMBER_OF_MSB+BIT_NUMBER_OF_LSB)}=216=65,536 \text{ GCLK cycles}$$

Adopting the S-PWM scheme, assuming a 16-bit resolution display with 11 bits of MSB data, 5 bits of LSB data, a scan number of 8, and a frame rate of 60 Hz, the refresh rate is 1920 Hz, but the GCLK frequency is significantly lower, as shown below.

$$\text{GCLK frequency}=2^{16}\times 60\text{ Hz}\times 8=31.45\text{ MHz}$$

$$\text{Refresh rate}=60\text{ Hz}\times 2^{BIT_NUMBER_OF_LSB}=60\text{ Hz}\times 32=1920\text{ Hz}$$

Furthermore, the PWM value can be expressed as follows:

$$\text{PWM value}=\text{MSBd}*2^{BIT_NUMBER_OF_LSB}+\text{LSBd}$$

whereby MSBd stands for the MSB data and LSBd stands for the LSB data. The MSB data is displayed in every segment in the data frame while LSB data is placed into segments when the LSB data are available. In other words, the LSB data determines whether the last GCLK cycle in each segment should be on or off, while the MSB data determines the number of the rest of GCLK cycles. In this approach, the MSB data is the same for all the segments.

For example, when the MSB data is 00000000011 and the LSB data is 00010, the MSB data of 3 is displayed in all 32 segments, while LSB data of 2 is divided into two with one data put into Segment 0 and Segment 31. That is Segment 0 and Segment 31 has (3+1) GCLK cycles and Segments 1-30 each has 3 GCLK cycles. The total PWM value is 98, i.e., 3×32+2=98. If the MSB data is 00000000100 and the LSB data is 00011, each segment displays the MSB data of 4 while the LSB data of 3 is distributed into three segments, e.g., Segments 0, 30, and 31. The total PWM value is 131, i.e., 4×32+3=131.

According to a conventional S-PWM scheme, the MSB data is displayed in every segment in the data frame. A look up table is implemented to allocate the LSB data in the segments. The LSB data for each channel is handled with dedicated memory and look up table. In other words, each channel requires its own dedicated LSB circuit. Using such conventional S-PWM to drive a number of channels poses problems, including large overhead, large chip area, and high power consumption. Accordingly there exists a need for devices and methods that overcome these shortcomings.

SUMMARY OF INVENTION

The current disclosure provides an LED display control circuit. The control circuit has a device configured to separate a first PWM data into LSB data and MSB data. The control circuit also comprises a LSB circuit coupled to a plurality of LED channels. The LSB circuit is configured to supply LSB data to each of the plurality of LED channels sequentially.

To do so, the LSB circuit is coupled to a plurality of latches, each of the latch is associated with one of the plurality of LED channels. The latches are configured to block or to release the LSB data to their corresponding LED channels. The latches are turned on and off so that LSB data is released to the plurality of LED channels. Furthermore, the LSB data released from the latch is combined with the MSB data to generate a second PWM signal. The second PWM signal is outputted to the each of the LED channels.

The current disclosure also provides a method for controlling a scan-type LED display. A control circuit is coupled to the scan-type LED display that has scan lines and channels. The control circuit separates a first PWM data into MSB data and LSB data; and outputs the LSB data into a LSB circuit. The LSB circuit is coupled a plurality of LED channels. The LSB circuit is configured to supply LSB data to each of the plurality of LED channels sequentially. To do so, the LSB circuit is coupled to a plurality of latches, each of the latch is associated with one of the plurality of LED channels. The latches are configured to block or to release the LSB data to their corresponding LED channels. The latches are turned on and off so that LSB data is released to each of the plurality of LED channels.

In one embodiment, the LSB circuit comprises a static random-access memory (SRAM) unit implemented to store LSB data for all channels and scan lines a look up table, such as ROM, electrically connected to the static random-access memory, a multiplexer (MUX) electronically connected to the read-only memory and a plurality of PWM channels electronically connected to the multiplexer. Each channel further corresponds to a shift register for storing data, a latch for controlling the data flow, and a MSB data storage unit.

In another embodiment, the control circuit further comprises a first pipeline register electronically connected to the SRAM and the look up table for temporarily storing data, a second pipeline register electronically connected to the look up table and the multiplexer for temporarily storing data.

DESCRIPTIONS OF DRAWINGS

The teachings of the present disclosure can be readily understood by considering the following detailed description in conjunction with the accompanying drawings.

FIG. 1 schematically illustrates PWM and S-PWM having 5 LSB bits.

Figure 2:
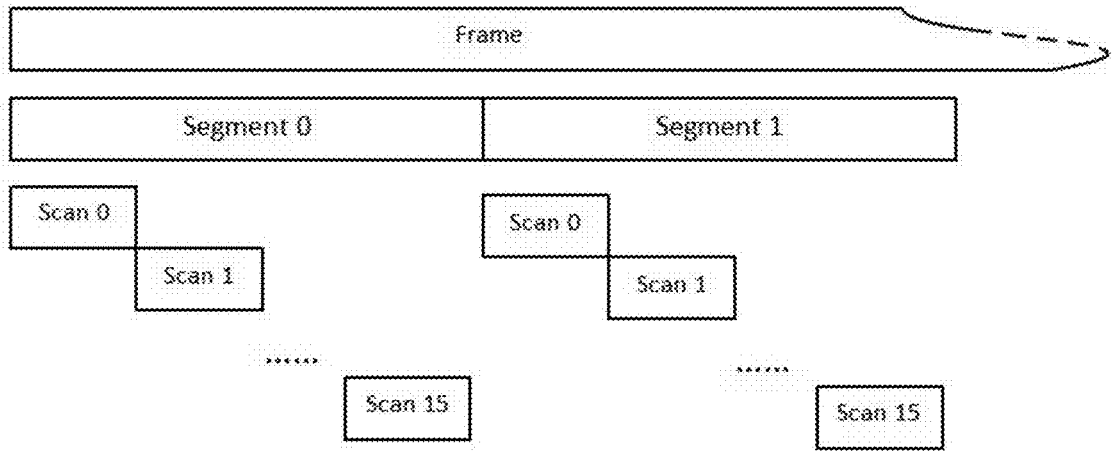

FIG. 2 schematically illustrates a timing diagram of a PWM signal according the current disclosure.

Figure 3:
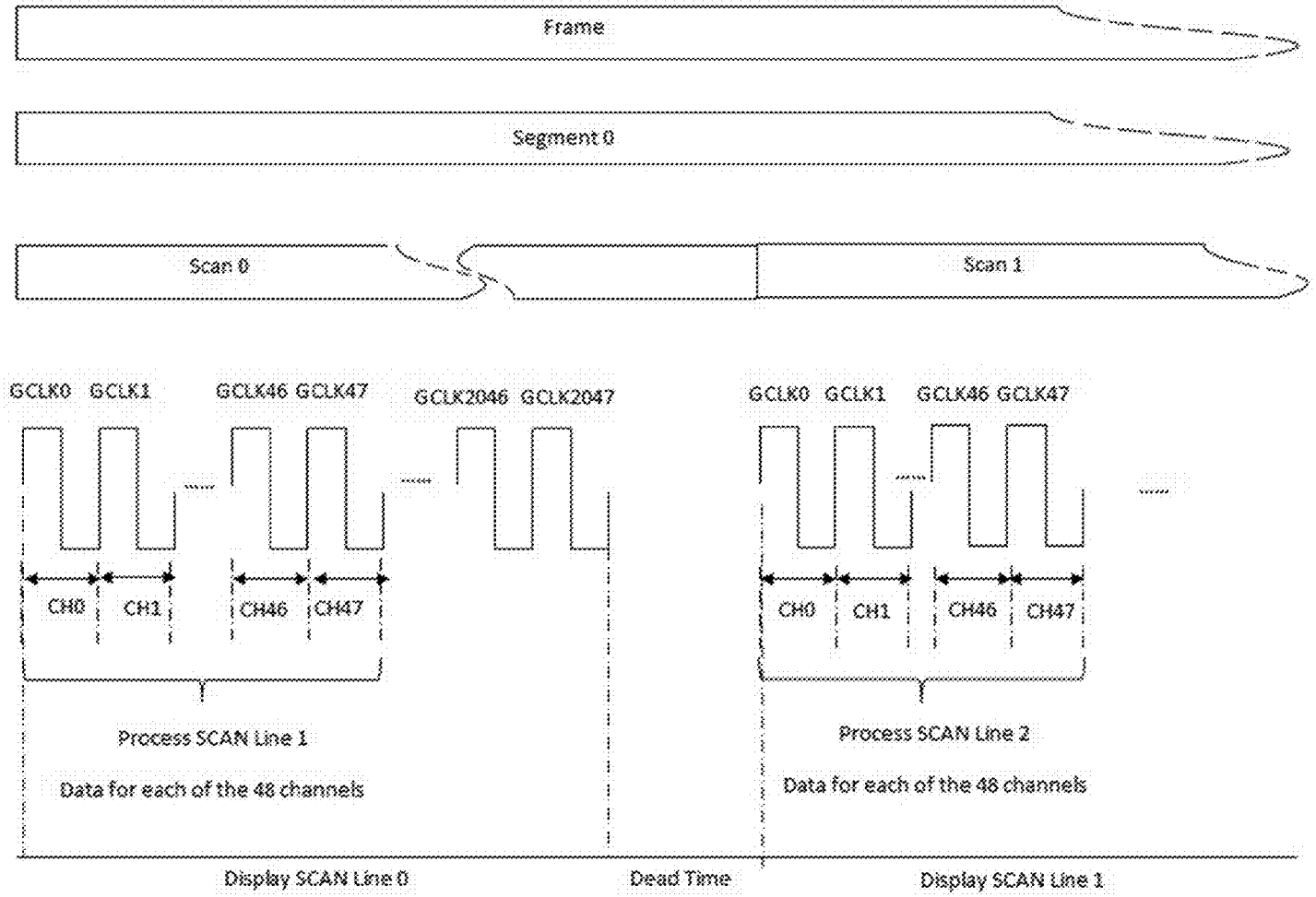

FIG. 3 schematically illustrates a method of driving the LED display according to the current disclosure.

Figure 4:
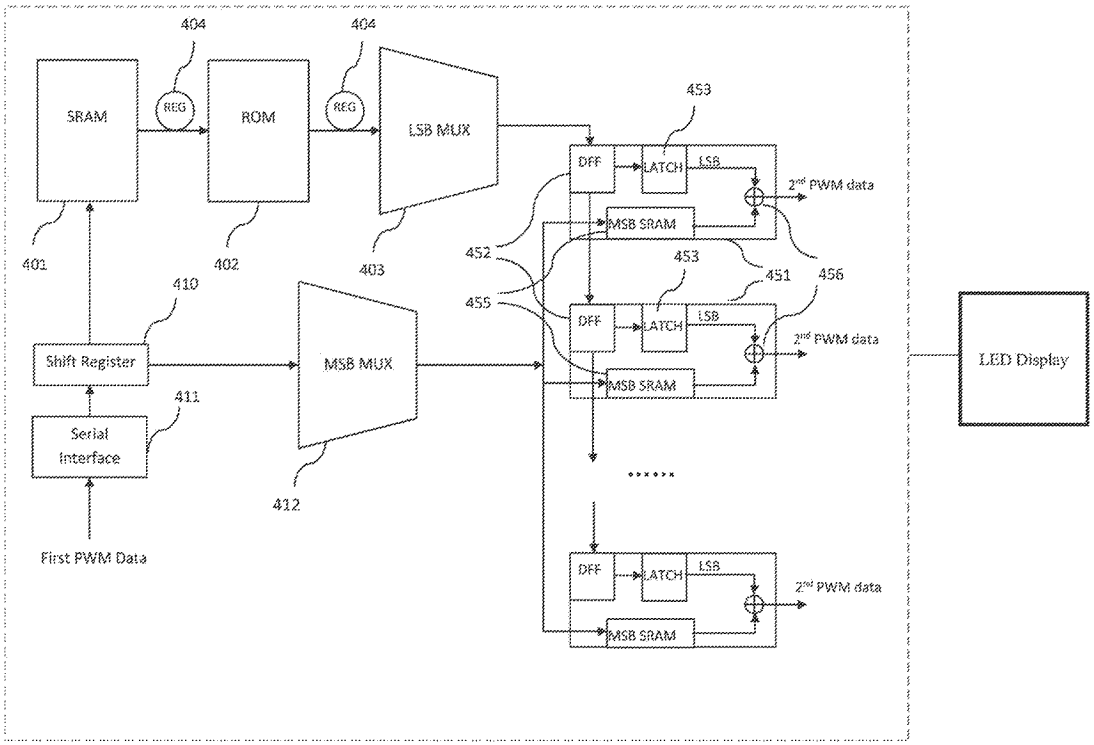

FIG. 4 schematically illustrates a circuit according to the current disclosure.

DETAILED DESCRIPTION OF THE EMBODIMENT

The Figures (FIG.) and the following description relate to the embodiments of the present disclosure by way of illustration only. It should be noted that from the following discussion, alternative embodiments of the structures and/or methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

FIG. 2 schematically illustrates a scan mechanism according to the current disclosure, in which each data frame is divided into $2^{BIT_NUMBER_OF_LSB}$ segments. In each segment a plurality of scan lines (16 scan lines in this case) are driven (or "scanned") sequentially. There is a deadtime period (not shown in FIG. 2) between the completion of displaying of the line data of one scan and the start of the next scan line. According to the current disclosure, the scan line data for the next scan line is read and processed during the current scan period, e.g., data for Scan 1 is processed during Scan 0.

FIG. 3 shows details in the scan sequence. In particular, it illustrates Scan 0 and Scan 1 in Segment 0 of the embodiment of FIG. 2. According to FIG. 3, each scam line is allocated 2048 GCLK cycles for display, i.e., GCLK0 to GCLK2047. A deadtime exists between adjacent scan lines, e.g., Scan 0 and Scan 1. Furthermore, when Scan Line 0 is being displayed, data for the next scan line, i.e., scan line 1, is processed. Note that in this case, data for Channel 0 (CH0) to Channel 47 (CH47)—a total of 48 channels—are processed in the first 48 GCLK cycles (GCLK0-GCLK47). The same process is repeated for the next scan line in the current segment and for all remaining scan lines. When the processing of all scan lines in the current segment is finished, the same process is repeated for the next segment, and sequentially for each of all the remaining segments in the frame. Once a frame has been displayed, the next frame follows. In this way, the frame data is displayed circularly and repeatedly.

The number of channels can be any suitable number greater or less than 48 as long as the LSB circuit can finish processing the LSB data for all channels during the allocated time. In addition, when the LSB circuit also include pipeline registers, more GCLK cycles are required to process the LSB data for all channels.

In the embodiment shown in FIG. 3, since the LSB data for the next scan line is processed and ready to be loaded while the current scan line is being displayed, only one LSB circuit is needed to process the LSB data for all channels.

FIG. 4 is a block diagram for the circuit in accordance with one embodiment of the present disclosure. As shown in FIG. 4, the first PWM data is transmitted into a serial interface 411 and from there to a shift register 410. The shift register 410 divides the PWM data into the MSB data and the LSB data. The MSB data is transmitted into a memory in each channel while the LSB data is transmitted to a LSB circuit. In particular, the LSB circuit has SRAM 401 and ROM 402. The LSB data is initially stored in SRAM 401. During a display, the LSB data for the next scan line is read out from SRAM memory 401. The content of the SRAM memory 401 then goes through the ROM 402 and is translated into the LSB pulse locations according to the look up table in ROM 402 (i.e., the ROM table). The MUX 403 determines whether the LSB data needs to be counted based on the segment information. In this case, the LSB data for all the channels are processed and loaded into their corresponding shift registers, such as the DFF (D Flip-Flop) 452 in the channels 451. While the scan line is being displayed, the latches 453 are turned off so that the LSB data is blocked. At the start of the deadtime, an update signal is sent to the latch 453 in all channels 451 and turns the latch 453 on so that the LSB data for all channels 451 are updated. Therefore, both the LSB data and the MSB data from the MSB SRAM 455 input into the adders 456 to generate the second PWM data for the next scan. Accordingly, the data for the next scan, e.g., Scan 1, is ready during the deadtime between Scan 0 and Scan 1. In this embodiment, the LSB circuit is shared among all the channels. Because of this simplification of the circuit, the top chip area for the control circuit is smaller compared with the scenarios when each channel has its own designated LSB circuit.

Note that the embodiment in FIG. 4, the each channel has its own designated storage for the MSB data—SRAM 455, whereby the MSB data, through the MSB MUX 412, is loaded into SRAM 455 for each channel. Alternatively, the MSB data for each channel may be stored on one memory and shared among all channels.

In a further embodiment, pipeline registers 404 are implemented between the SRAM 401, the ROM 402, and the MUX 403 for faster clock cycle and higher throughput design.

Many modifications and other embodiments of the disclosure will come to the mind of one skilled in the art having the benefit of the teaching presented in the forgoing descriptions and the associated drawings. For example, the LED array in the display may be arranged in a common cathode configuration, in which each of a plurality of common cathode nodes is connected with cathodes of the LEDs of a same color in a same row. The common cathode nodes are operably connected to power sources. Alternatively, the LED array may be arranged in a common anode configuration, in which each of a plurality of common anode nodes is connected with anodes of LEDs of a same color in the same column. The common anode nodes are operably connected to power sources. Details of common anode configuration have been disclosed in U.S. application Ser. No. 13/041,427, filed Mar. 6, 2011, incorporated herein by reference.

Elements in the LED array can be single color LEDs or RGB units or any other forms of LEDs available. The control circuit can be scaled up or scaled down to drive LED arrays of various sizes. Multiple control circuits may be employed to drive a plurality of LED arrays in a LED display system. The components in the driver can either be integrated on a single chip or on more than one chip or on the PCB board. Such variations are within the scope of this disclosure. It is to be understood that the disclosure is not to be limited to the specific embodiments disclosed, and that the modifications and embodiments are intended to be included within the scope of the dependent claims.

What is claimed is:

1. An LED display control circuit, comprising:

a device configured to separate a first PWM data into an LSB data and a MSB data;

an LSB circuit coupled to a plurality of LED channels, wherein the LSB circuit comprises a LSB SRAM that stores the LSB data;

a ROM coupled to the LSB SRAM, wherein the ROM stores a look up table;

a LSB multiplexer coupled to the ROM for multiplexing the LSB data into each of the plurality of LED channels, a MSB multiplexer for multiplexing the MSB data to each of the plurality of LED channels, wherein each of the plurality of LED channels comprises a MSB SRAM for storing the MSB data received from the MSB multiplexer, a shift register for storing the LSB data received from the LSB multiplexer, and a latch coupled to the shift register, wherein the latch is configured to block or release the LSB data received from the LSB multiplexer.

2. The LED display control circuit of claim 1, wherein the LSB data stored in the shift register in each of the plurality of LED channels is released from the latch sequentially and the released LSB data combines the MSB data in the MSB SRAM to generate a second PWM data.

3. The LED display control circuit of claim 1, further comprising a pipeline register located between the SRAM and the ROM.

* * * * *